US006932706B1

(12) United States Patent
Kaminkow

(10) Patent No.: US 6,932,706 B1
(45) Date of Patent: Aug. 23, 2005

(54) ELECTRONIC GAMING UNIT WITH VIRTUAL OBJECT INPUT DEVICE

(75) Inventor: Joseph E. Kaminkow, Reno, NV (US)

(73) Assignee: International Game Technology, Reno, NV (US)

( * ) Notice: Subject to any disclaimer, the term of this patent is extended or adjusted under 35 U.S.C. 154(b) by 0 days.

(21) Appl. No.: 09/777,433

(22) Filed: Feb. 6, 2001

(51) Int. Cl.[7] ..... A63F 9/22
(52) U.S. Cl. ..... 463/36; 463/16; 463/12; 463/13; 463/18; 463/20
(58) Field of Search ..... 463/29, 36; 382/135

(56) References Cited

U.S. PATENT DOCUMENTS 4,185,825 A * 1/1980 Bromley ..... 463/5
4,799,683 A * 1/1989 Bruner, Jr. ..... 463/13
4,856,787 A * 8/1989 Itkis ..... 273/237
4,885,565 A * 12/1989 Embach ..... 340/407.2
5,027,415 A * 6/1991 Hara et al. ..... 356/71
5,266,931 A * 11/1993 Tanaka ..... 345/173
5,393,057 A * 2/1995 Marnell, II ..... 273/269
5,413,357 A * 5/1995 Schulze et al. ..... 463/23
5,565,148 A * 10/1996 Pendergrass, Jr. ..... 261/30
5,605,504 A * 2/1997 Huang ..... 463/22
5,618,232 A * 4/1997 Martin ..... 463/25
5,700,195 A * 12/1997 Halic ..... 194/206
5,770,533 A * 6/1998 Franchi ..... 463/16
5,800,265 A * 9/1998 Yamazaki et al. ..... 463/23
5,816,918 A * 10/1998 Kelly et al. ..... 463/16
5,913,727 A * 6/1999 Ahdoot ..... 345/156
5,971,850 A 10/1999 Liverance ..... 463/23
6,017,272 A * 1/2000 Rieder ..... 463/31
6,025,830 A * 2/2000 Cohen ..... 345/156
6,251,011 B1 * 6/2001 Yamazaki ..... 434/17
6,270,410 B1 * 8/2001 DeMar et al. ..... 273/143 R
6,311,976 B1 * 11/2001 Yoseloff et al. ..... 273/138.2
6,368,213 B1 * 4/2002 McNabola ..... 463/18
6,429,846 B2 * 8/2002 Rosenberg et al. ..... 345/156
6,509,896 B1 * 1/2003 Saikawa et al. ..... 345/419

OTHER PUBLICATIONS

Wagner, et al., Human Factors Design Guide, 1996, US DOT, 3-13, 8-3, 4, 41, 42, 53, 88, 126.*

* cited by examiner

*Primary Examiner*—Jessica Harrison
*Assistant Examiner*—Corbett Coburn
(74) *Attorney, Agent, or Firm*—Marshall, Gerstein & Borun LLP

(57) ABSTRACT

An electronic gambling unit for allowing a user to play a video gambling game, may generally include a virtual object input device that allows the user to make a plurality of input selections and a display unit being capable of generating color images. The electronic gambling unit may further include a currency-accepting mechanism that is capable of allowing the user to deposit a medium of currency and a controller operatively coupled to the display unit and the input device.

9 Claims, 10 Drawing Sheets

ELECTRONIC GAMING UNIT WITH VIRTUAL OBJECT INPUT DEVICE

TECHNICAL FIELD

The invention relates generally to electronic gambling units, more specifically, to electronic gambling units having virtual objects as input devices.

BACKGROUND OF THE INVENTION

Electronic gambling units continue to become increasingly complex. Older electronic gambling units such as slot machines merely required a player to pull a lever and examine three spinning reels to determine whether the same symbol appears in the winning position on all three reels, meaning the player was a winner. There were no bonus rounds and players only had to review one line of symbols (the pay line) to determine whether a winner was received. In addition, there were few differences between slot machines that would encourage a user to choose one machine over another.

Modern electronic gambling units are designed to be more attractive to users and to be appealing to a wider range of users. Modern electronic gambling units can incorporate games beyond traditional slot machines to make the games more interesting. To further increase interest in the game, awards can be correlated with skill in playing a game making the game even more interesting to play or bonus awards can be attached to different aspects of the game to make the game more interesting. In addition, other games with non-traditional selection devices such as touch screens and joysticks have been added to entice players to try new games.

SUMMARY OF THE INVENTION

According to one aspect, the present invention may be embodied in an electronic gambling unit for allowing a user to play a video gambling game. Such an electronic gambling unit may include a virtual object input device that allows the user to make a plurality of input selections. The electronic gambling unit may further include a display unit that may be capable of generating color images. The electronic gambling unit may further include a currency-accepting mechanism that is capable of allowing the user to deposit a medium of currency and a controller operatively coupled to the display unit and the input device. The controller may include a processor and a memory operatively coupled to the processor.

The controller may be programmed to allow the user to make a wager via the input device after the currency-accepting mechanism detects deposit of currency by the user and to cause a sequence of video images to be generated on the display unit after the currency-accepting mechanism detects deposit of currency by the user, the sequence of video images representing a video gambling game. The controller may be further programmed to determine, after the sequence of images has been displayed, an outcome of the video gambling game represented by the sequence of images and to determine a currency payout associated with the outcome of the video gambling game.

The features and advantages of the present invention will be apparent to those of ordinary skill in the art in view of the detailed description of various embodiments, which is made with reference to the drawings, a brief description of which is provided below.

DETAILED DESCRIPTION OF VARIOUS EMBODIMENTS

Figure 1:
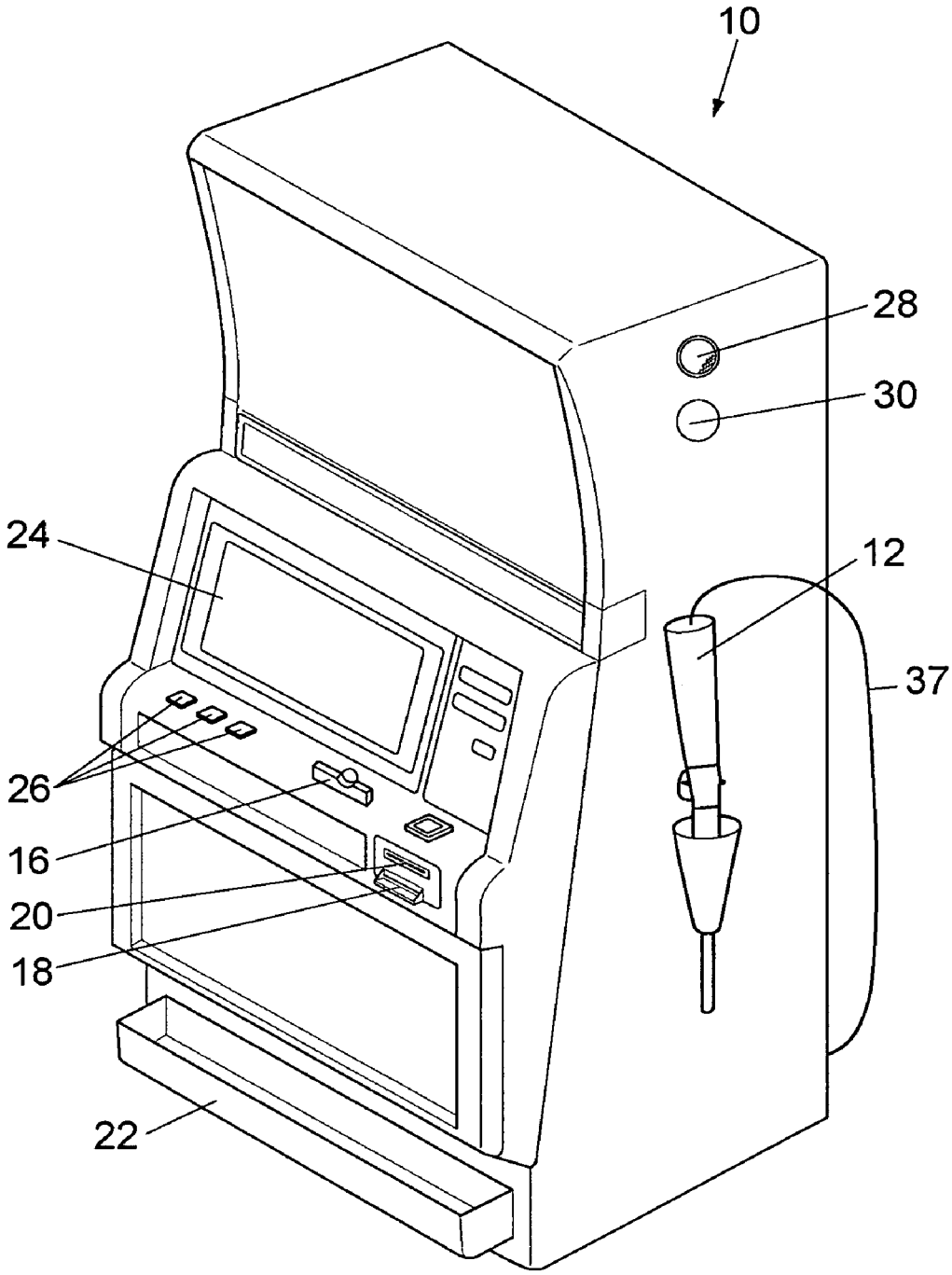
FIG. 1 is an exemplary illustration of an electronic gambling unit designed in accordance with the teachings of the present invention.
Figure 2A:
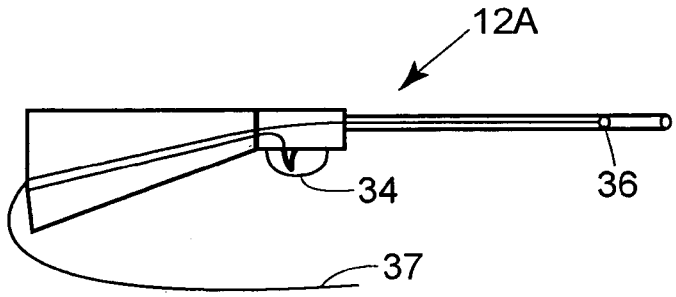
FIGS. 2A–2F are exemplary illustrations of virtual objects designed in accordance with the teachings of the present invention.
Figure 2B:
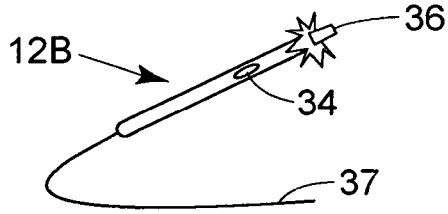
Figure 2C:
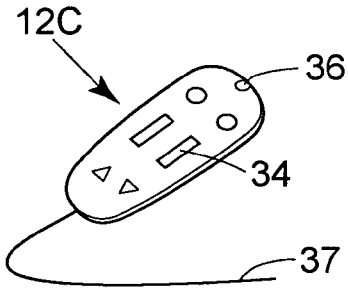
Figure 2D:
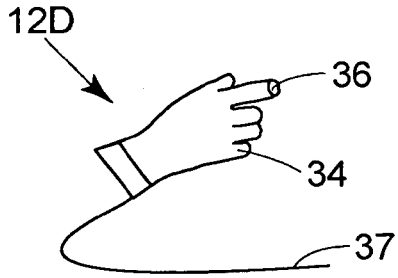
Figure 2E:
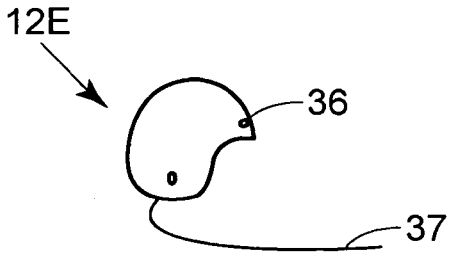
Figure 2F:
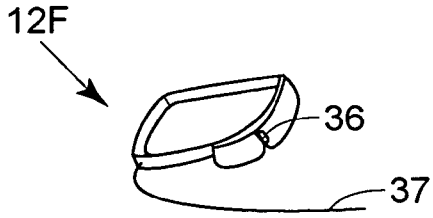

Referring to FIG. 1, one embodiment of an electronic gambling unit 10 with a virtual object 12 is illustrated. The electronic gambling unit 10 may have a housing made of wood or other sturdy material. The electronic gambling unit 10 may have a currency accepting mechanism 14 such as a coin acceptor 16, a dollar bill acceptor 18, a debit card acceptor 20 and acceptors of other monetary media. The electronic gambling unit 10 also may have a coin payout tray 22 and may have a display device 24 on which various games such as blackjack, five card draw poker, seven card draw poker, keno, slots and the like may be displayed. The electronic gambling unit 10 may have several input devices 26 such as push buttons, a touch screen, a joystick, a track ball or the like and the virtual object 12 which may assist in selecting and playing a game.

The electronic gambling unit 10 may be outfitted with the display unit 24, audio speakers 28 and a scent dispenser 30 to provide audio, visual and scent stimulation, respectively. Generally, to facilitate user interaction with the electronic gambling unit 10, the input devices 26 are provided. The user may employ the display unit 24 and the input devices 26 to gamble by playing games such as, for example, video poker, video blackjack, video slot machine games (also referred to hereinafter as "video slots") or video matching games. As will be appreciated by those having ordinary skill in the art, the types of gambling games that may be implemented on the electronic gambling unit 10 are virtually limitless. Accordingly, any gambling games disclosed herein are presented purely for reasons of example and are not intended to be limiting in any manner. For example, other gambling games such as Montana poker, bingo or keno may be implemented on the electronic gambling unit 10.

Referring to FIGS. 2A–2F, the virtual object 12 may contain a light pen held inside a shaped shell. The virtual object 12 may be shaped to resemble a virtual gun 12*a*, a virtual magic wand 12*b*, a virtual remote control 12*c*, a virtual glove 12*d*, a virtual pointing helmet 12*e*, virtual goggles (such as those used in modern fighter planes) 12*f* or other pointable input devices as is understood by one skilled in the art. For example, the virtual object 12 may be made of plastic and may be painted and weighted to appear to look like and feel like an actual firearm. The virtual object 12 may be any well known firearm shape such as a rifle, a shotgun, an Uzi, an AK-47 or a traditional six-shooter revolver. Other firearm shapes may be acceptable.

In addition, feedback may be added to the virtual object 12 to make the object feel even more realistic. For example, when the virtual object 12 is a virtual gun 12*a* and, when a selection switch 34 such as a trigger is pulled on the virtual gun 12*a*, it may kickback as a result of the shots being fired. Such feedback can be accomplished by spinning an unevenly weighted disc inside the virtual gun 12*a*. Lights, sound, smoke and even changes in temperature may be added to the virtual gun 12*a* to make it feel even more realistic when shots are fired. Similar feedback can be added to other virtual objects 12. For example, the end of a virtual magic wand may light up when the virtual magic wand is used.

The light pen inside the virtual object 12 may be any of several well known and commercially available light pens. A light pen sold by Inkwell Systems may be used and a light pen sold by Design Technology Inc. may also be used, although other suppliers are acceptable. The light pen may have a light-sensing end that points out the barrel of the virtual object 12 in the same direction as a bullet would exit the virtual gun 12*a*.

The light pen may contain a light sensitive device such as a photodetector 36 that converts the illumination at a particular point on the display device 24 at a specific instant in time into an electrical pulse that is communicated to a controller 46 (FIG. 4) through traditional communication devices such as a bus 37. The controller 46 may be a video controller or another controller. The controller 46 may obtain the coordinates of the current point of illumination at a specific instant of time as the electron beam scans across the display device 24 and illuminates points on the display device 24. The controller 46 may match the specific instant of time at which illumination was detected with the location on the display device 24 at which the controller was illuminating at that specific instant in time to determine the location on the display device 24 at which the virtual object 12 was pointing. The controller may then save the location where the illumination was detected in an x, y format. The light pen also may have the selection switch 34 such as a contact switch and the signal of the selection switch 34 may be communicated to the controller 46. In addition, the selection switch on the light pen which produces a separate input to the controller (similar to the button on a computer mouse) may be connected to the selection switch 34 on the virtual object 12. Of course, other pointing devices could be made part of the virtual object 12, such as a light transmitter (either visible light or invisible light) mounted inside the virtual object 12 and light receivers mounted on the display device 24.

The virtual object 12 may also have a light source and the photodetector 36 may be attached to the display device 24 and the photodetector 36 may determine the location on the display device 24 at which the virtual object 12 and its built-in light source was pointed. Accordingly, the virtual object 12 may be used with displays that do not have a sweeping electron beam such as liquid crystal and plasma display devices.

The virtual object 12 may also have gyroscopes which enable the virtual object 12 to determine its position in space in relation to the gaming unit 10 as is understood by one skilled in the art. For example, if the virtual object 10 is a pointing helmet 12*e*, it may have gyroscopes which will determine the elevation, attitude and altitude at which the helmet 12*e* is pointing, and this directional data will be communicated to the controller 46.

Figure 3:
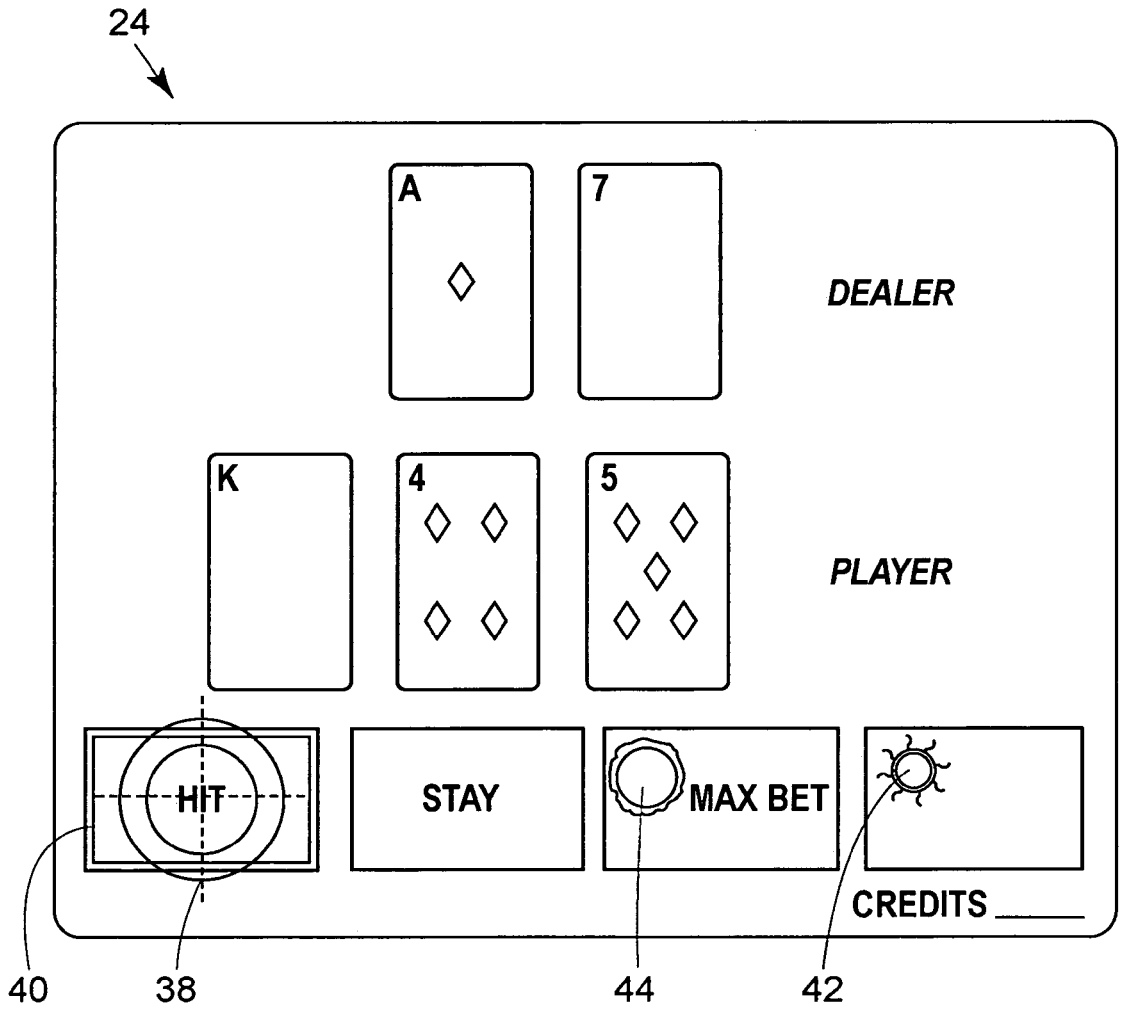
FIG. 3 is an exemplary illustration of graphics which may be displayed on the display unit when the virtual object is used as an input device.

Referring to FIG. 3, the location on the display device 24 at which the virtual object 12 is pointing may be indicated by displaying a crosshair 38 on the location. Such items upon which the crosshair 38 may be displayed may be selectable items 40. Selectable items 40 may be objects or icons displayed on the display device 24 that cause a further action, such as an icon to increase a bet or an icon to cash out of a game. For example, in video blackjack, items such as "hit" or "stay" may be selectable items 40. Further, in certain games where cards are kept or discarded such as draw poker, the cards themselves may be selectable items 40. When the crosshair 38 is displayed over selectable items 40, they may change appearance to indicate they are selectable items 40. For example, in video blackjack, the outside border around the selectable items 40 may change color when the crosshair 38 is displayed over the selectable items 40.

If the user activates the selection switch 34 (FIGS. 2A–2D) on the virtual object 12, a virtual indicator 42 may appear at the location on the display device 24 at which the virtual object 12 is pointing. For example, if the virtual object 12 is a virtual gun 12*a*, a virtual bullet may be the virtual indicator 42, and once the virtual bullet 42 is fired, the location of the virtual bullet 42 may be indicated by a virtual bullet hole 44. The virtual bullet hole 44 may fade away after a short period, such as five seconds. As another example, the virtual indicator 42 may also be a magic sparkle when the virtual object 12 is a magic wand 12*b*.

In addition, one skilled in the art will realize that the virtual object 12 may not need to be the sole and exclusive input device 26. Other input devices 26 such as touch screens, buttons, joysticks, trackballs and the like may be use alone or in combination with the virtual object 12.

Figure 4:
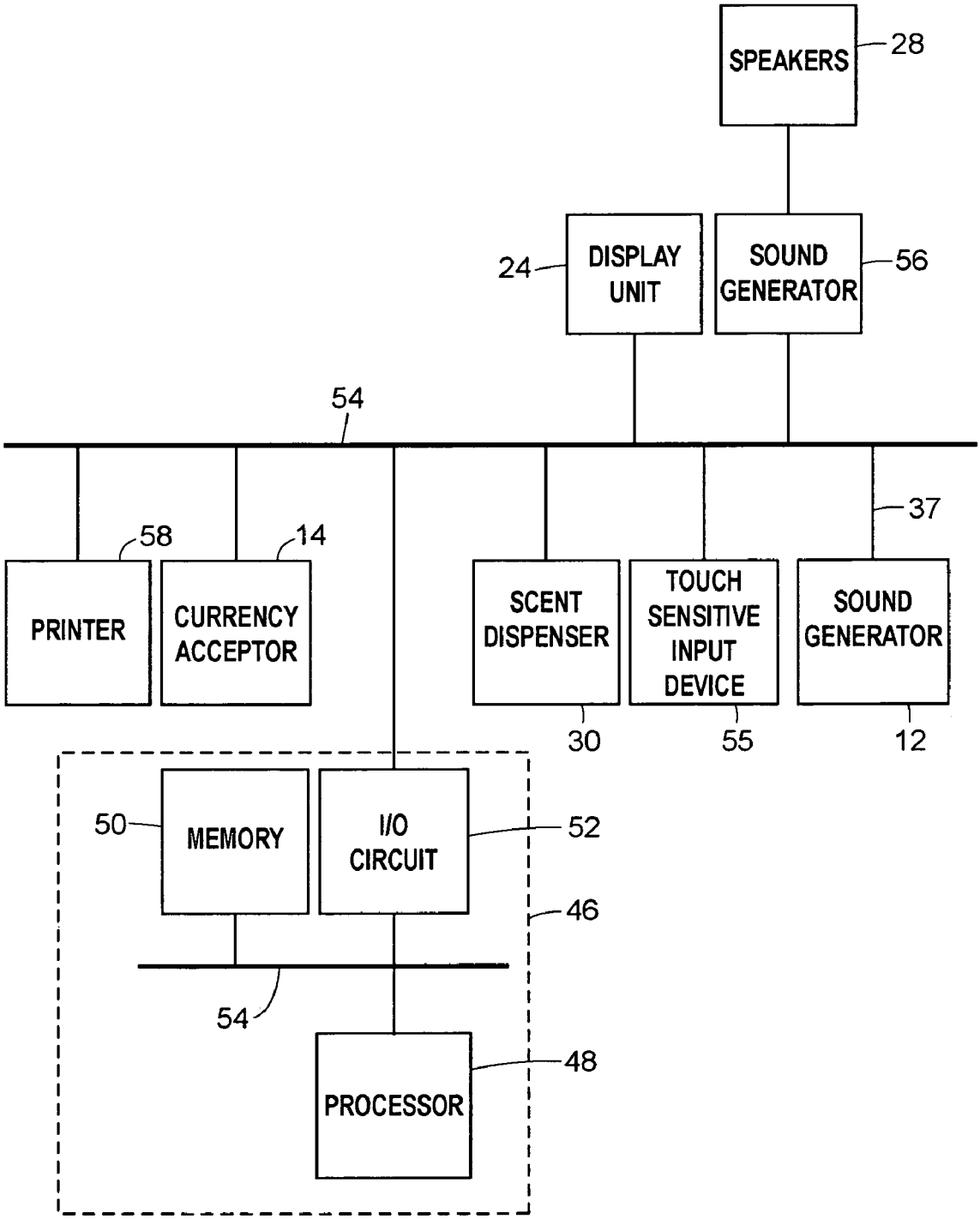
FIG. 4 is an exemplary block diagram of the hardware components of the electronic gambling unit of FIG. 1.

Referring to FIG. 4, a game controller 46 may be disposed inside the gambling unit 10. The game controller 46 may be coupled to the display unit 24, the scent dispenser 30, the audio speakers 28 via a cabling harness (or bus). The game controller 46 may be embodied hardware that is commercial available in, for example, the International Game Technology "Game King" platform for video gambling machines. The game controller 46 may be embodied in a 16 or 32 bit, 16 megahertz (MHZ) 80C960SA microcontroller, which is commercially available from Intel, or may be embodied in any other suitable microcontroller. As shown in detail in FIG. 4, the game controller 46 may include a processor 48 that is communicatively coupled to both of a memory 50 and an input/output circuit 52, via a bus 54. The memory 50 of the game controller 46 may be random access memory (RAM), read only memory (ROM) or any suitable combination thereof. Alternatively or additionally, an additional memory may be communicatively coupled to the game controller 46. For example, a memory such as any one, or any suitable combination, of an electrically erasable programmable read only memory (EEPROM), a one time programmable electrically programmable read only memory (OTP EPROM), a static random access memory (SRAM), FLASH or any other suitable memory element may be externally connected to the microcontroller. Further detail regarding the functionality of the game controller is described hereinafter with respect to FIGS. 5–11.

The display unit 24 may be a color display unit, a monochrome display or any other suitable display. Further, the display unit 24 may be embodied in a cathode ray tube (CRT) monitor, a plasma display, a liquid crystal display (LCD) or any other suitable display technology. For example, the display device 24 in the electronic gambling unit 10 may be a traditional cathode ray tube type display wherein an electron beam scans across the inside of the display device 24 and illuminates phosphor to create illumination on the inside of the display which is visible on the display device 24. Additionally, the display unit 24 may have a touch-sensitive input device 55 installed thereon. Such a touch screen may be available from MicroTouch or any other suitable vendor.

The display unit 24 is controlled to enable the user to play video gambling games thereon. For example, as is described in more detail hereinafter, the display unit 24 may display graphics representative of, for example, slot machine reels, playing cards, dice or any other suitable symbols to enable a user to play a video version of commonly known casino games. The input device 26 enables the user to interact with the electronic gambling unit 10 to, for example, make wagers, to select cards, to discard cards and to perform any other suitable functions that correspond to traditional casino games. Further detail regarding exemplary graphics that may be displayed on the display screen is provide hereinafter with respect to FIGS. 7, 9, and 11.

The audio speakers 28, which may be embodied in speakers that are commercially available from Boston Acoustics under model number $CX9^3$, or may be embodied in any other suitable speakers, cooperate with a sound generator 56 to provide various forms of audio that are relevant to the video gambling game that the user is playing. For example, the sound generator 56, which may be any suitable and known audio generating circuit, may generate signals representing sounds such as the noise of spinning slot machine reels, a dealer's voice, music, announcements or any other suitable audio related to a video gambling game.

The scent dispenser 30, which may be mounted to the display unit 24 or may be mounted in any other suitable location on the electronic gambling unit 10, may be manufactured by MicroScent or DigiScents.

The currency accepting mechanism 14 may be disposed in any suitable location on the gambling unit. The currency accepting mechanism 14 may be embodied in any device that can accept value from the user. For example, the currency accepting mechanism 14 may be a bill validator, a smart card reader, a token acceptor or any other suitable and known device capable of handling currency, token or electronic currency. By way of particular example, the currency accepting mechanism 14 may be embodied in a bill validator that is commercially available from Japanese Coin Mechanisms (JCM) under model number WBA-12-SS. As shown in FIG. 4, the currency accepting mechanism 14 may be coupled to, and controlled by the controller 46. When a user deposits value into the currency accepting mechanism 14, a representation of the value that the user has may be displayed to the user on the display unit 24. As the user plays various video gambling games, the value may be incremented as the user wins and may be incremented as the user wins and may be decremented as the user loses.

A printer 58 may also be disposed in any suitable location of the gambling unit 10. The printer 58, which may be responsive to the controller 46, may be used for printing tickets of the winnings of a user. For example, when a user desires to cash out, the printer may print a ticket having the number of user credits printed thereon. The user may then redeem the printed ticket for cash, a check, or credit at a casino facility. One exemplary printer 58 is available from SEIKO Instruments USA, Inc. under model number PSA-66-00N.

Referring now to FIGS. 5, 6, 8 and 10, a number of routines are shown that are illustrated using blocks, which represent functions that may be embodied in software instructions stored in the memory 50 (FIG. 4) and carried out by the processor 48 (FIG. 4). The instructions may be written in any suitable high level language such as, for example, any suitable version of C, C++ or the like. Alternatively, instructions for implementing the functional blocks may be written in any suitable assembly or machine level language.

Figure 5:
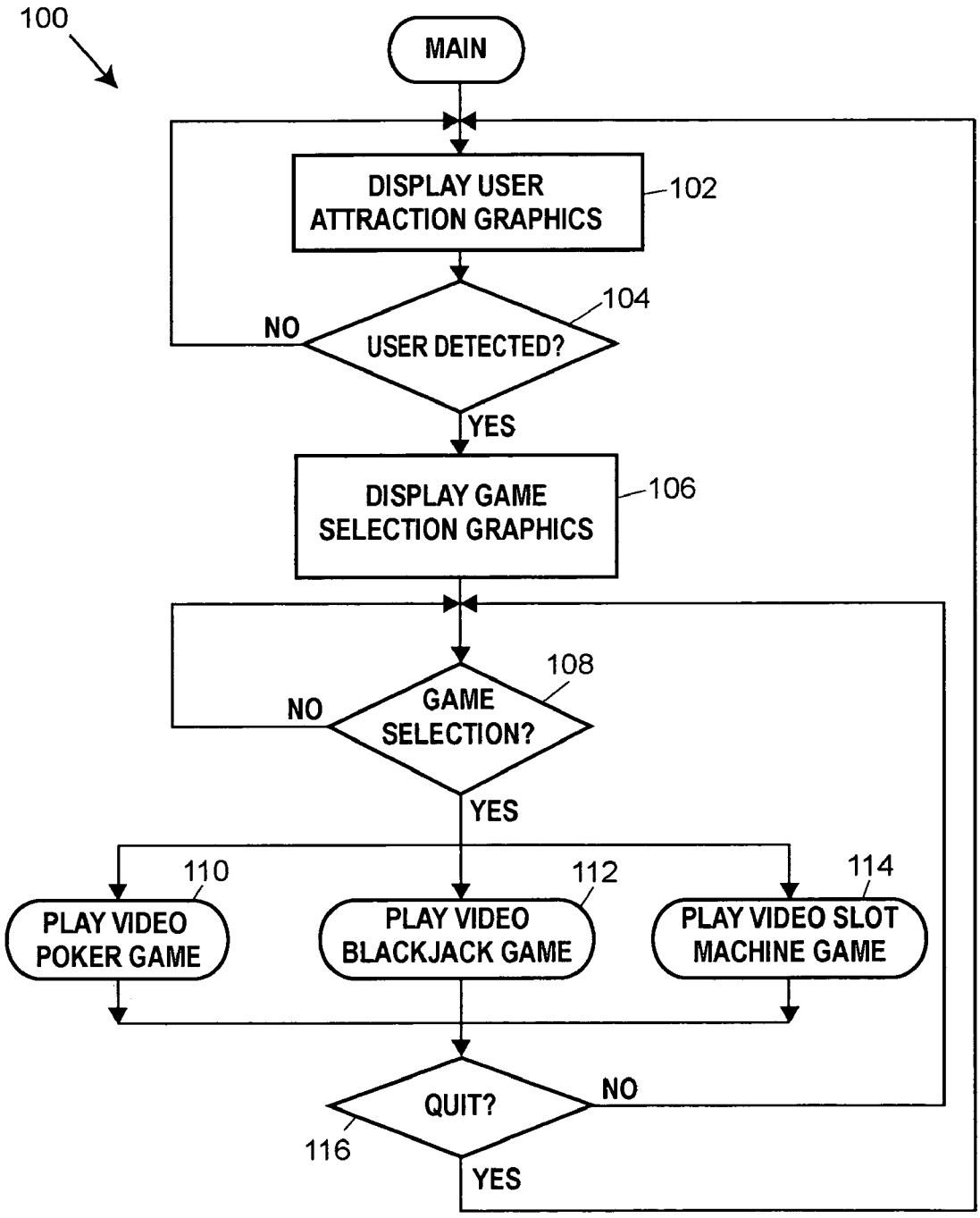
FIG. 5 is an exemplary flow diagram of a main control routine that may be implemented by the controller of FIG. 4.

As shown in FIG. 5, a main routine 100 may begin execution at a block 102 at which user attraction graphics may be displayed on the display unit 24. User attraction graphics may include a scrolling list of games that may be played on the electronic gambling unit 10, cartoons, videos, etc. While graphics are being displayed, a block 104 intermittently checks to see is a user is detected. Such a function may be carried out by, for example, polling the currency acceptance mechanism 14. As long as no user is detected, control passes from the block 104 back to the block 102. If, however, the block 104 determines that a user is present, control passes to a block 106.

The execution of the block 106 causes the display unit 24 to display a game selection graphic to the user. The game selection graphic may include a list of video gambling games that may be played on the electronic gambling unit 10.

After the block 106 displays the list of available video gambling games to the user, a block 108 detects which game has been selected and branches control to one of subroutines 110–114, each of which represents a particular video gambling game. It should be noted that although three subroutines are shown in FIG. 5, more, fewer or different subroutines representing more, fewer or different video gambling games may be used. Accordingly, more, fewer or different video gambling games may be present on any given electronic gambling unit 10. The description of the subroutines 110–114 is undertaken with respect to FIGS. 6, 8 and 10 after the remaining blocks of FIG. 5 are described.

After one of the subroutines 110–114 have been executed, control passes to a block 116, which queries whether the user has expressed a desire to stop playing the electronic gambling unit 10. The user may express such a desire by selecting a quit graphic displayed on the display unit 24 or through any other suitable manner that informs the game controller 46 (FIG. 4) of the user's desire to stop playing the electronic gambling unit 10. If the user does not desire to quit, control passes from the block 116 back to the block 108 so that the user may select another video gambling game to play. If, however, the user desires to quit, control passes from the block 116 to a block 102, at which time the electronic gambling unit 10 again displays graphics to attract another user.

Figure 6:
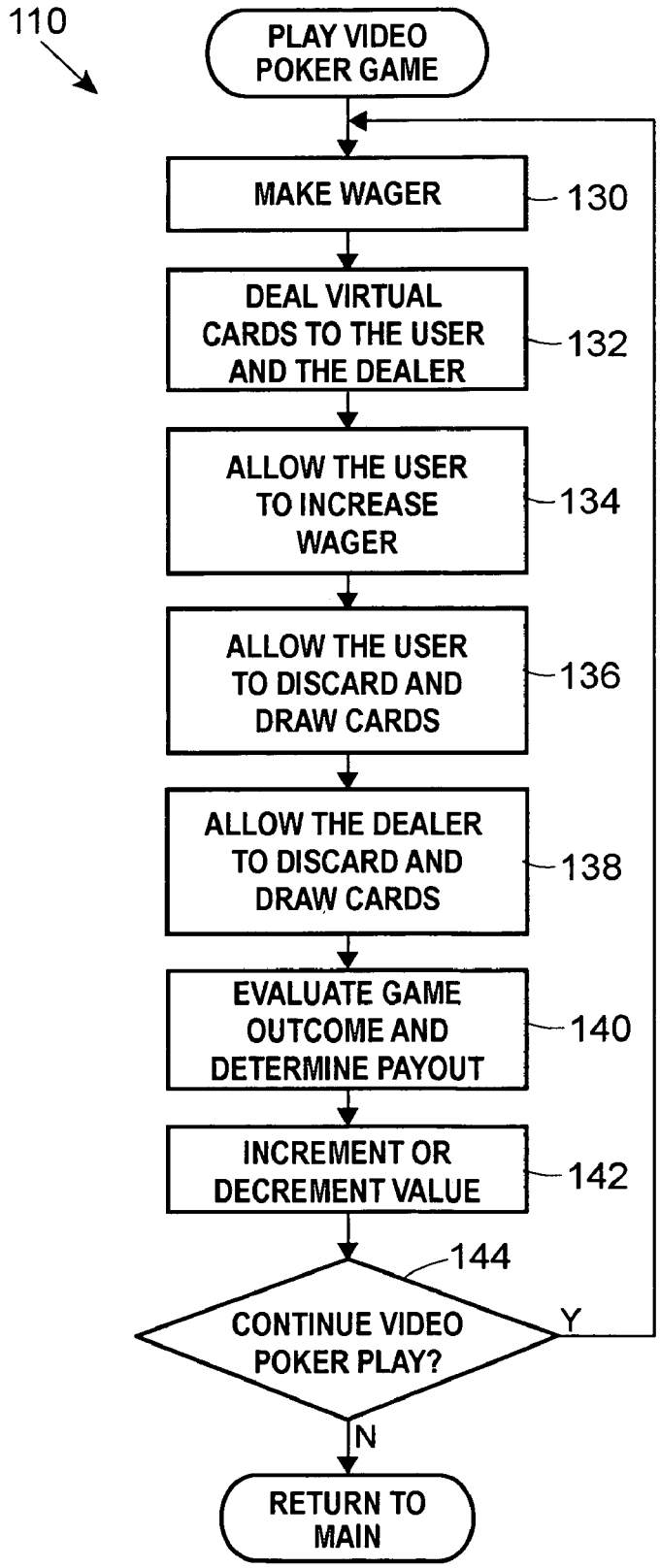
FIG. 6 is an exemplary flow diagram of a play video poker game routine that may be implemented by the controller of FIG. 4.

When the block 108 determines that the user desires to play a video poker game, control passes to the subroutine 110, which is illustrated in detail in FIG. 6. As described hereinafter, the various blocks of the subroutine 110 recite various functions that are carried out by the game controller 46 in conjunction with the display unit 24 to make certain graphics appear on the display unit 24. Exemplary graphics for a video poker game are shown and described in conjunction with FIG. 7.

At a block 130, the subroutine 110 requests the user to make a wager and, after a wager is entered, control passes to a block 132, at which virtual hands of cards are dealt to the user and to the dealer, which is the opponent of the user (e.g., the dealer may be considered to be the game controller 46 (FIG. 4), which is competing against the user). After the virtual hands have been dealt to the user and the dealer, the user may have an opportunity at the block 134 to increase the initial wager made at the block 130. After the block 134 executes, control passes to a block 136, which allows the user to discard and draw cards in an attempt to improve the user's virtual hand.

After the user has had the opportunity to improve his or her hand at the block 136, control passes to a block 138, at which the dealer has the opportunity to improve its hand by discarding and drawing cards. After the block 138 has completed, control passes to a block 140, at which the game controller 46 (FIG. 4) determines the outcome of the game and determines the payout. If the user has won the game (e.g., the user's hand is better than the dealer's hand), the payout will be positive. If, however, the user has not won the game, the user may forfeit his wagers made at the block 130 and 134. After the block 140 has determined the outcome, control passes to a block 142, which increments or decrements the user's value based on the results determined at the block 140.

After the user's value has been incremented or decremented at the block 142, a block 144 queries whether the user desires to continue playing the video poker game. If the user desires to play the video poker game again, control passes from the block 144 back to the block 130, which requests the user to make a wager. If the user does not desire to continue playing the video poker game, execution returns to the block 116 of the routine 100 of FIG. 5.

Figure 7:
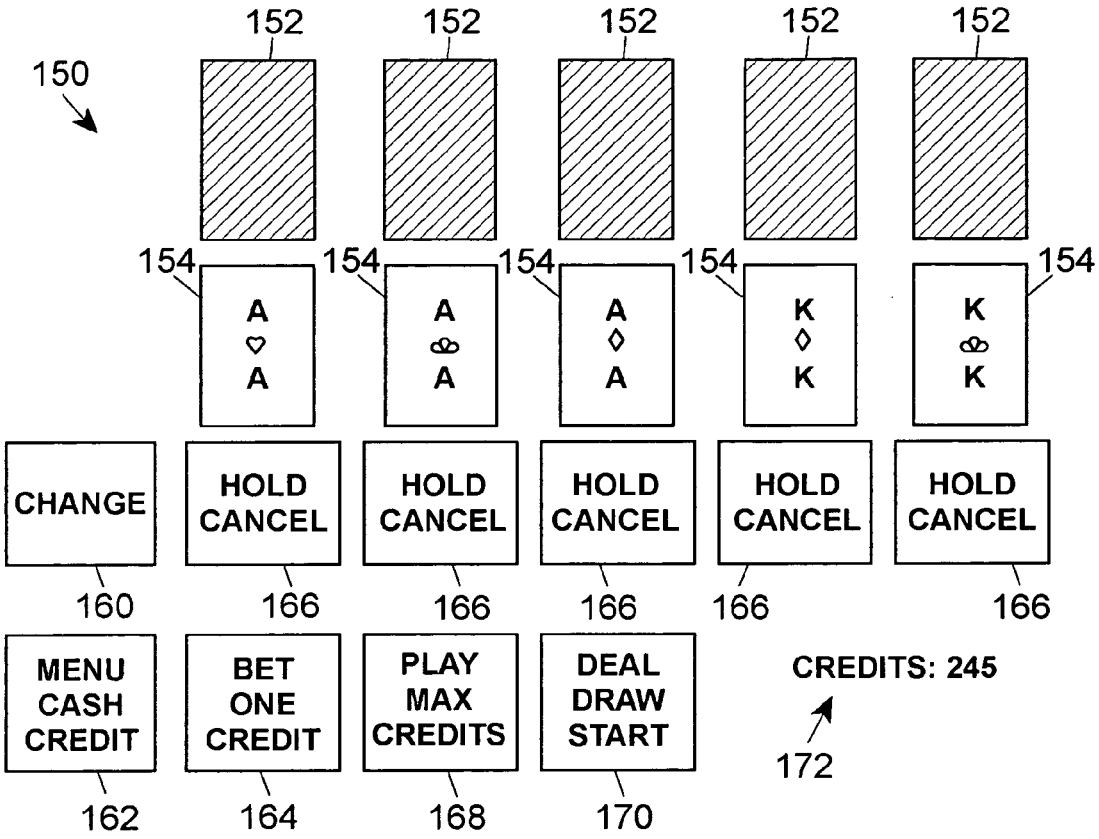
FIG. 7 is an exemplary illustration of graphics that may be displayed on the display unit when the controller of FIG. 4 executes the play video poker routine of FIG. 6.

As shown in FIG. 7, an exemplary video display 150, which may be associated with the play video poker game routine 110, may include video images representative of a plurality of cards 152 in a dealer's hand, which may be shown face down, and a plurality of cards 154 in a user's hand, which may be shown face up. To allow the user to control the play of the video poker game, a plurality of button graphics may be displayed. In particular, button graphics for change 160, menu/cash/credit 162 and bet one credit 164 may be displayed. Further, button graphics for hold/cancel 166 may be displayed, each of which may pertain to a particular one of the user's cards 154. Button graphics for play max credits 168 and deal/draw/start 170 may also be displayed. Accordingly, each of the button graphics 160–170 may be associated with a particular area on the display unit 24. The graphics 160–170 may be selectable items 40 and may be selected using the virtual object 12. A graphic representing the number of credits 172 may also be displayed to inform the user of the number of credits that he or she has remaining.

Figure 8:
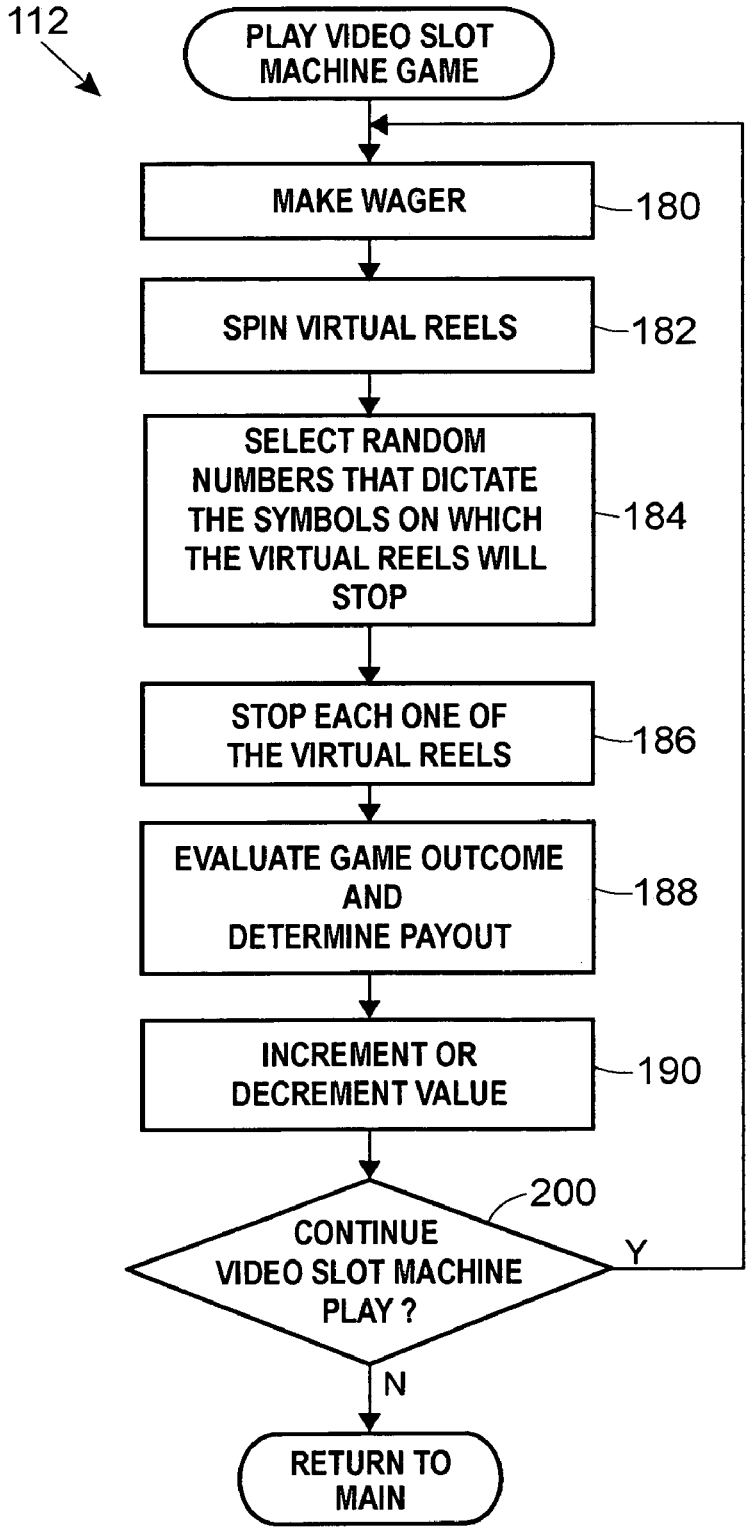
FIG. 8 is an exemplary flow diagram of a play video slot machine routine that may be implemented by the controller of FIG. 4.

When a user desires to play a video slot machine game, a play video slot machine game routine 112, as shown in FIG. 8, is executed. The routine 112 includes a number of blocks that may be embodied in software instructions stored in the memory 50 (FIG. 4). The execution of the routine 112 may begin at a block 180, at which a user may make a wager on the outcome of the video slot machine game. After the user has made an appropriate wager, control passes to a block 182. At the block 182 virtual slot machine reels, which may be embodied in video graphics, begin to spin to simulate the operation of a traditional mechanical slot machine.

While the virtual reels spin, a block 184 may select one or more random numbers that dictate the symbols on which the various virtual reels will stop when the reels cease spinning. Essentially, the block 184 determines the outcome of the video slot machine game. After the block 184 completes, control passes to a block 186, which stops each one of the virtual reels from spinning. The virtual reels may be stopped in a left to right manner, from the perspective of the user, or in any other suitable manner or sequence.

After the virtual reels have been stopped by the block 186, a block 188 evaluates the game outcome and determines the payout to which the user is entitled. For example, if the virtual reels have stopped on high payout symbols, the user may receive a large payout. If, however, the virtual reels have stopped on symbols having no payout, the user loses the money that was wagered at the block 180. After the payout has been determined at the block 188, a block 190 appropriately increments or decrements the value that the user has accumulated within the electronic gambling unit 10 and passes control to a block 200.

The block 200 determines whether the user desires to continue to playing the video slot machine game. If the user desires to play again, control passes from the block 200 back to the block 180. If, however, the user does not desire to play again, control passes to the block 116 of the main routine 100 of FIG. 5.

Figure 9:
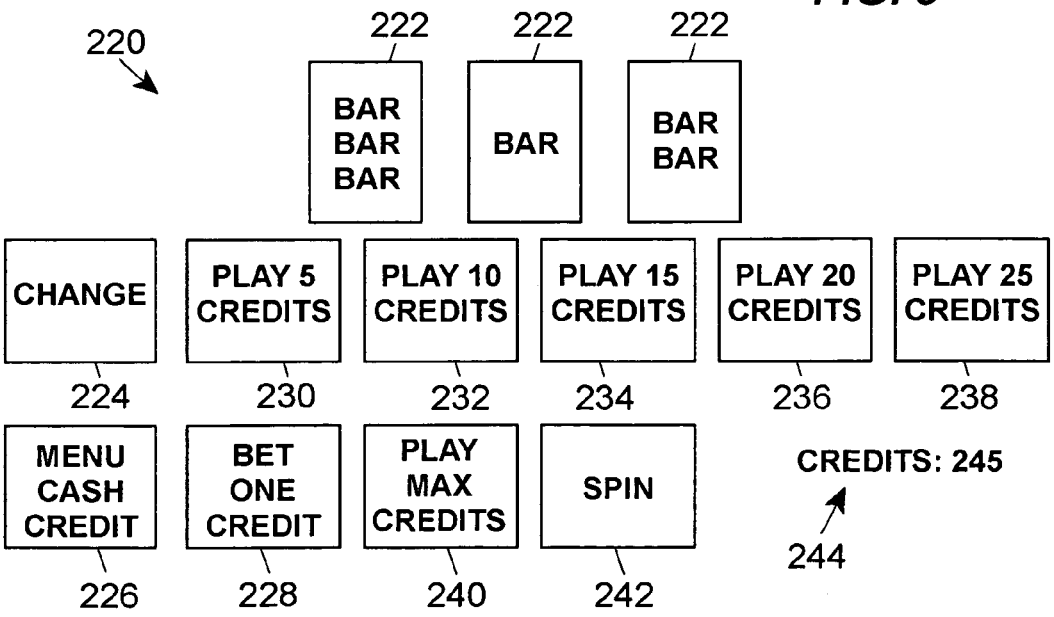
FIG. 9 is an exemplary illustration of graphics that may be displayed on the display unit when the controller of FIG. 4 executes the play video slot machine routine of FIG. 8.

As shown in FIG. 9, an exemplary video display 220, which may be associated with the play video slot machine game routine 112, may include video images that represent a plurality of virtual slot machine reels 222. While three such virtual slot machine reels 222 are shown in FIG. 9, it should be understood that any number of virtual reels could be used. To allow the user to control the play of the video slot machine, a plurality of button graphics may be displayed. In particular, button graphics for change 224, menu/cash/credit 226 and bet one credit 228 may be displayed. Further, button graphics for betting 5, 10, 15, 20 or 25 credits, shown as 230–238 in FIG. 9 may also be provided. Button graphics for play max credits 240 and spin 242 may also be displayed. Accordingly, each of the button graphics 224–242 may be associated with a particular area of the display unit 24. The graphics 224–242 may be selectable items 40 and may be selected using the virtual object 12. A graphic representing the number of credits 244 may also be displayed to inform the user of the number of credits that he or she has remaining.

Figure 10:
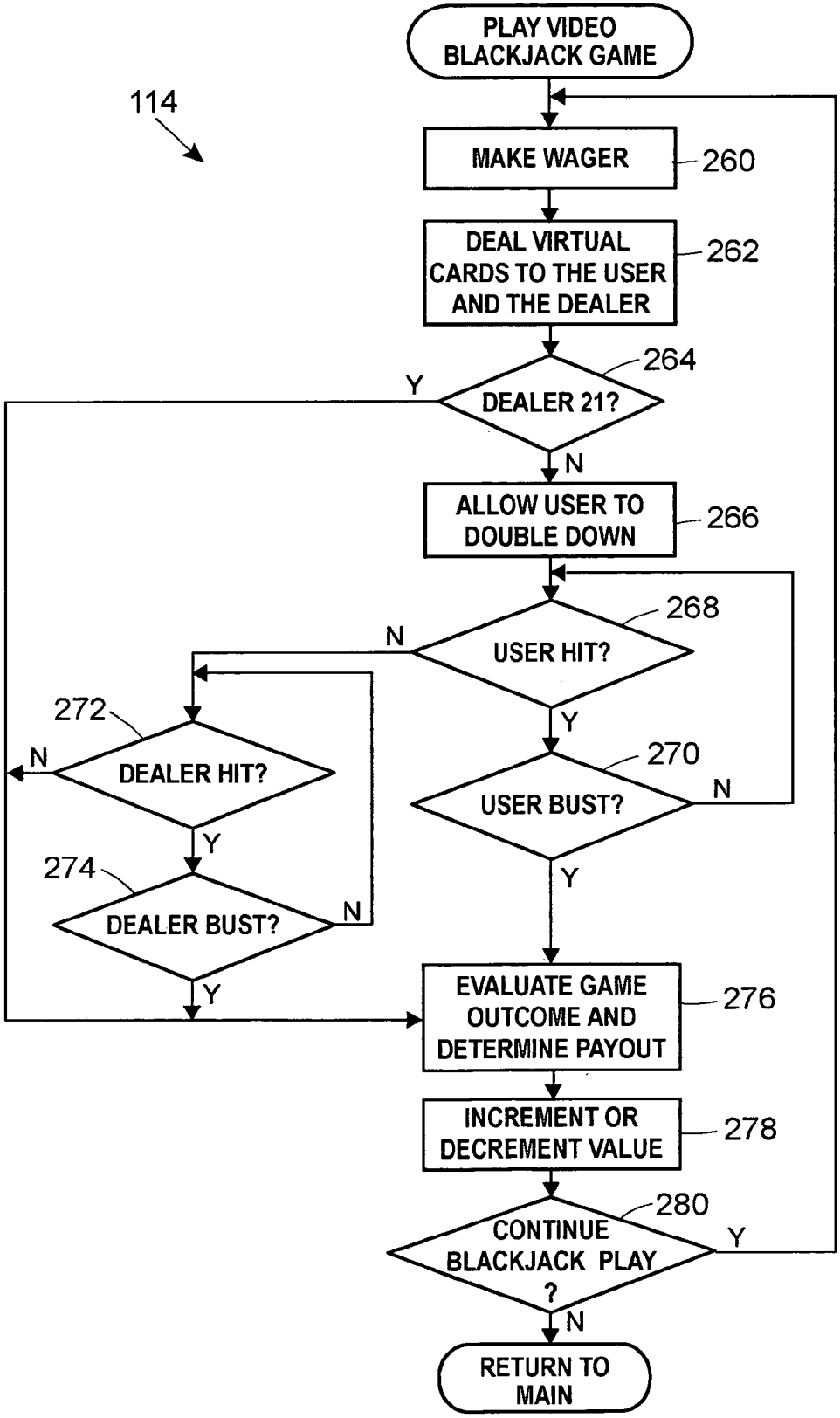
FIG. 10 is an exemplary flow diagram of a play video blackjack game routine that may be implemented by the controller of FIG. 4.

When a user desires to play a video blackjack game, a play video blackjack game routine 114, as shown in FIG. 10, is executed. The routine 114 includes a number of blocks that may be embodied in software instructions stored in the memory 50 (FIG. 4). The execution of the routine 114 may begin at a block 260 at which a user makes a wager on the outcome of the blackjack game. After the user has made a wager, a block 262 deals virtual cards to both of the user and the dealer, against which the user is playing.

After the cards are dealt, a block 264 tests whether the dealer has a hand that totals to 21. If the user does not have 21, control passes to a block 266, at which the user may double down. After the execution of the block 266, a block 268 determines whether the user wants to be "hit" (i.e., be dealt an additional card). If the user is hit, a block 270 determines if the user has "bust" (i.e., has exceeded 21). If the user has not bust, control passes back to the block 268, which allows the user to hit again.

If the user decides not to hit, control passes from the block 268 to a block 272, which determines if the dealer wants to hit. If the dealer hits, control passes to a block 274, which determines if the dealer has bust. If the dealer has not bust, control passes from the block 274 back to the block 272 to provide the dealer another opportunity to hit. If the dealer decides not to hit, control passes to a block 276, which determines the outcome of the blackjack game. For example, the block 276 may determine which of the user or the dealer has the higher hand that does not exceed 21. Additionally, if the user busts at the block 270 or the dealer busts at the block 274 or if the block 264 determines that the dealer has 21, control passes to the block 276. In sum, the block 276 performs the function of evaluating the traditional rules of blackjack and determining the magnitude of the payout that should be paid to the user.

After the block 276 determines the outcome and payout for the game, control passes to a block 278, which increments or decrements the value of the user based on the payout calculated by the block 276. Upon completion of the block 278, the block 280 determines whether the user desires to play another game of blackjack. If the user desires to play blackjack again, control passes to the block 260. Alternatively, if the user does not desire to play blackjack again, control passes to the block 116 of the main routine 100 of FIG. 5.

Figure 11:
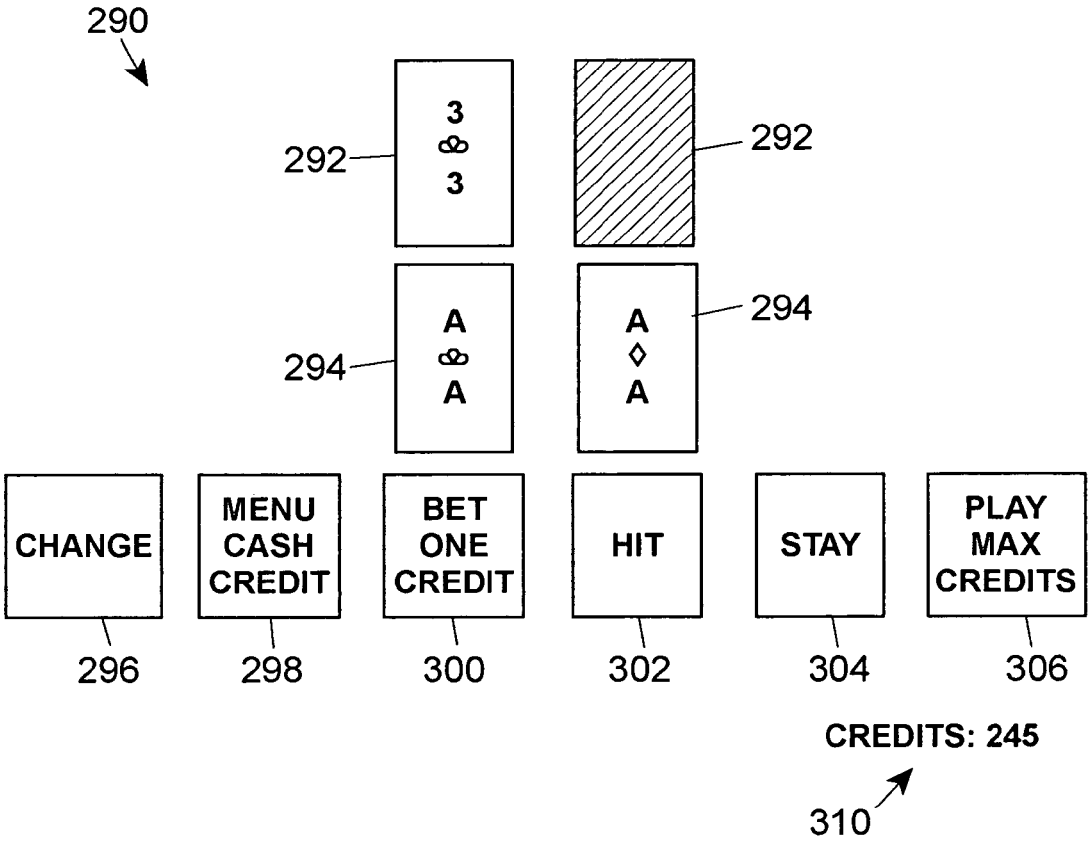
FIG. 11 is an exemplary illustration of graphics that may be displayed on the display unit when the controller of FIG. 4 executes the play video blackjack machine routine of FIG. 10.

As shown in FIG. 11 an exemplary video display 290, which may be associated with the play blackjack game routine 114, may include video images that represent a plurality of cards 292 that form a dealer's hand of cards and a plurality of cards 294 that form the user's hand of cards. To allow the user to control the play of the video blackjack game, a plurality of button graphics may be displayed. In particular, button graphics for change 296, menu/cash/credit 298 and bet one credit 300 may be displayed. Further, button graphics for hit 302, stay 304 and play max credits 306, as shown in FIG. 9 may also be provided. Accordingly, each of the button graphics 296–306 may be associated with a particular area of the display unit 24. The graphics 296–306 may be selectable items 40 and may be selected using the virtual object 12. A graphic representing the number of credits 310 may also be displayed to inform the user of the number of credits that he or she has remaining.

Modifications and alternative embodiments of the invention will be apparent to those skilled in the art in view of the foregoing description. This description is to be construed as illustrative only, and is for the purpose of teaching those skilled in the art the best mode of carrying out the invention. The details of the structure and method may be varied substantially without departing from the spirit of the invention, and the exclusive use of all modifications which come within the scope of the appended claims is reserved.

What is claimed is:

1. An electronic gaming unit for allowing a user to play at least one video game selected from the group of video games consisting of video poker, video slots, video blackjack, video bingo and video keno, the electronic gaming unit comprising:

a display unit that is capable of generating color images;

a currency-accepting mechanism that is capable of allowing the user to deposit a medium of currency;

a user input device comprising a virtual object, said virtual object being at least one selected from the group of virtual objects comprising:

a virtual magic wand shaped like a magic wand;

a virtual remote control shaped like a remote control;

a virtual pointing helmet shaped like a pointing helmet;

a set of virtual pointing goggles shaped like a set of pointing goggles;

a virtual pointing glove shaped like a pointing glove; and a virtual gun shaped like a firearm and having a portion shaped like a trigger; and a controller operatively coupled to the display unit, the currency-accepting mechanism and the virtual object, the controller comprising a processor and a memory operatively coupled to the processor;

the controller being programmed to allow the user to make a wager after the currency-accepting mechanism detects deposit of currency by the user;

the controller being programmed to cause a sequence of video images to be generated on the display unit after the currency-accepting mechanism detects deposit of currency by the user, the sequence of video images representing a video game selected from the group of video games consisting of video poker, video slots, video blackjack, video bingo and video keno, at least one of the images comprising an image of at least three playing cards if the video game is video poker;

at least one of the images comprising an image of a plurality of simulated slot machine reels if the video game is video slots;

at least one of the images comprising an image of a plurality of playing cards if the video game is video blackjack;

at least one of the images comprising an image of a bingo grid if the video game is bingo; and at least one of the images comprising an image of a keno grid if the video game is keno;

the controller being programmed to cause a portion of the said images to be highlighted in response to the user pointing the virtual object at the portion of said images;

the controller being programmed to cause the virtual object to provide feedback to the user through the virtual object when a selectable item is selected, wherein the feedback is based on a characteristic of the virtual object; and the controller being programmed to determine, after the sequence of images has been displayed, an outcome of the video game represented by the sequence of images and to determine a currency payout associated with the outcome of the video game.

2. The electronic gaming unit of claim 1, wherein the display unit comprises a touch sensitive video display screen and wherein the user input device comprises part of the touch sensitive video display screen.

3. The electronic gaming unit of claim 1, wherein the controller is programmed to cause a set of cross-hairs to be displayed on one of the images in response to the user pointing the virtual object at a portion of the display device.

4. An electronic gaming unit for allowing a user to play at least one video game selected from the group of video games consisting of video poker, video slots, video blackjack, video bingo and video keno, the electronic gaming unit comprising:

a display unit that is capable of generating color images;

a currency-accepting mechanism that is capable of allowing the user to deposit a medium of currency;

a user input device comprising a virtual object, said virtual object being at least one selected from the group of virtual objects comprising:

a virtual magic wand shaped like a magic wand;

a virtual remote control shaped like a remote control;

a virtual pointing helmet shaped like a pointing helmet;

a set of virtual pointing goggles shaped like a set of pointing goggles;

a virtual pointing glove shaped like a pointing glove; and a virtual gun shaped like a firearm and having a portion shaped like a trigger;

a controller operatively coupled to the display unit, the currency-accepting mechanism and the virtual object, the controller comprising a processor and a memory operatively coupled to the processor, the controller being programmed to allow the user to make a wager after the currency-accepting mechanism detects deposit of currency by the user;

the controller being programmed to cause a sequence of video images to be generated on the display unit after the currency-accepting mechanism detects deposit of currency by the user, the sequence of video images representing a video game selected from the group of video games consisting of video poker, video slots, video blackjack, video bingo and video keno, at least one of the images comprising an image of at least three playing cards if the video game is video poker;

at least one of the images comprising an image of a plurality of simulated slot machine reels if the video game is video slots;

at least one of the images comprising an image of a plurality of playing cards if the video game is video blackjack;

at least one of the images comprising an image of a bingo grid if the video game is bingo; and at least one of the images comprising an image of a keno grid if the video game is keno;

the controller being programmed to cause a portion of the said images to be highlighted in response to the user pointing the virtual object at the portion of said images;

the controller being programmed to cause a selectable item to be selected in response to a user pointing the virtual object at the selectable item and selecting the item;

the controller being programmed to cause the virtual object to provide feedback to the user through the virtual object when a selectable item is selected, wherein the feedback is based on a characteristic of the virtual object; and the controller being programmed to determine, after the sequence of images has been displayed, an outcome of the video game represented by the sequence of images and to determine a currency payout associated with the outcome of the video game.

5. The electronic gaming unit of claim 4, wherein the controller is programmed to cause a set of cross-hairs to be displayed on one of the images in response to the user pointing the virtual object at a portion of the display device.

6. The electronic gaming unit of claim 4, wherein the display unit comprises a touch sensitive video display screen and wherein the input device comprises part of the touch sensitive video display screen.

7. An electronic gaming unit for allowing a user to play at least one video game selected from the group of video games consisting of video poker, video slots, video blackjack, video bingo and video keno, the electronic gaming unit comprising a display unit that is capable of generating color images;

a currency-accepting mechanism that is capable of allowing the user to deposit a medium of currency;

a user input device comprising a virtual object, said virtual object being at least one selected from the group of virtual objects comprising:

a virtual magic wand shaped like a magic wand;

a virtual remote control shaped like a remote control;

a virtual pointing helmet shaped like a pointing helmet;

a set of virtual pointing goggles shaped like a set of pointing goggles;

a virtual pointing glove shaped like a pointing glove; and a virtual gun shaped like a firearm and having a portion shaped like a trigger; and a controller operatively coupled to the display unit, the currency-accepting mechanism and the virtual object, the controller comprising a processor and a memory operatively coupled to the processor;

the controller being programmed to allow the user to make a wager via the input device after the currency-accepting mechanism detects deposit of currency by the user;

the controller being programmed to cause a sequence of video images to be generated on the display unit after the currency-accepting mechanism detects deposit of currency by the user, the sequence of video images representing a video game selected from the group of video games consisting of video poker, video slots, video blackjack, video bingo and video keno, at least one of the images comprising an image of at least three playing cards if the video game is video poker;

at least one of the images comprising an image of a plurality of simulated slot machine reels if the video game is video slots;

at least one of the images comprising an image of a plurality of playing cards if the video game is video blackjack;

at least one of the images comprising an image of a bingo grid if the video game is bingo; and at least one of the images comprising an image of a keno grid if the video game is keno;

the controller being programmed to cause one of the said images to be modified in response to the user pointing the virtual object at a portion of the display device;

the controller being programmed to cause a selectable item to be selected in response to a user pointing the virtual object at the selectable item and selecting the object;

the controller being programmed to cause a set of cross-hairs to be displayed on the portion of the images in response to the user pointing the virtual object at the portion of said images;

the controller being programmed to cause the virtual object to provide feedback to the user through the virtual object when a selectable item is selected, wherein the feedback is based on a characteristic of the virtual object; and the controller being programmed to determine, after the sequence of images has been displayed, an outcome of the video game represented by the sequence of images and to determine a currency payout associated with the outcome of the video game.

8. The electronic gaming unit of claim 7, wherein the display unit comprises a touch sensitive video display screen and wherein the input device comprises part of the touch sensitive video display screen.

9. An electronic gaming unit for allowing a user to play a video game selected from the group of video games consisting of video poker, video slots, video blackjack, video bingo and video keno, the electronic gaming unit comprising:

a display unit that is capable of generating color images;

a currency-accepting mechanism that is capable of allowing the user to deposit a medium of currency;

a user input device comprising a virtual object, said virtual object being at least one selected from the group of virtual objects comprising:

a virtual magic wand shaped like a magic wand;

a virtual remote control shaped like a remote control;

a virtual pointing helmet shaped like a pointing helmet;

a set of virtual pointing goggles shaped like a set of pointing goggles;

a virtual pointing glove shaped like a pointing glove; and a virtual gun shaped like a firearm and having a portion shaped like a trigger; and a controller operatively coupled to the display unit, the currency-accepting mechanism and the virtual object, the controller comprising a processor and a memory operatively coupled to the processor;

the controller being programmed to allow the user to make a wager via the input device after the currency-accepting mechanism detects deposit of currency by the user;

the controller being programmed to cause a sequence of video images to be generated on the display unit after the currency-accepting mechanism detects deposit of currency by the user, the sequence of video images representing a video gambling game selected from the group of video games consisting of video poker, video slots, video blackjack, video bingo and video keno, at least one of the images comprising an image of at least three playing cards if the video game is video poker;

at least one of the images comprising an image of a plurality of simulated slot machine reels if the video game is video slots;

at least one of the images comprising an image of a plurality of playing cards if the video game is video blackjack;

at least one of the images comprising an image of a bingo grid if the video game is bingo; and at least one of the images comprising an image of a keno grid if the video game is keno;

the controller being programmed to cause a portion of the said images to be highlighted in response to the user pointing the virtual object at the portion of said images;

the controller being programmed to cause a selectable item to be selectable in response to a user pointing the virtual object at the selectable item and selecting the item;

the controller being programmed to cause a set of cross-hairs to be displayed on the portion of the images in response to the user pointing the virtual object at the portion of said images;

the controller being programmed to cause the virtual object to provide feedback to the user through the virtual object when a selectable item is selected, wherein the feedback is based on a characteristic of the virtual object;

the controller being programmed to determine, after the sequence of images has been displayed, an outcome of the video game represented by the sequence of images and to determine a currency payout associated with the outcome of the video game; and a selection switch operatively coupled to the virtual object, wherein the controller is programmed to cause a virtual indicator to be displayed on a portion of one of the images in response to the user selecting the selectable item using the selection switch while the virtual object is pointed at the portion of the one image, wherein the virtual indicator is based on a characteristic of the virtual object.

* * * * *